US010883462B2

(12) United States Patent
Yabuuchi et al.

(10) Patent No.: US 10,883,462 B2
(45) Date of Patent: Jan. 5, 2021

(54) DAMPER DEVICE WITH A PLURALITY OF STACKED DIAPHRAGMS COUPLED TOGETHER BY A COUPLER HAVING HOLDERS FORMING A SPACE PROVIDED BETWEEN A PERIPHERAL WELD OF THE DIAPHRAGMS AND THE COUPLER

(71) Applicants: TOYOTA JIDOSHA KABUSHIKI KAISHA, Toyota (JP); DENSO CORPORATION, Kariya (JP); EAGLE INDUSTRY CO., LTD., Tokyo (JP)

(72) Inventors: Takeyuki Yabuuchi, Toyota (JP); Shinichi Sugimoto, Toyota (JP); Osamu Hishinuma, Kariya (JP); Hiroatsu Yamada, Kariya (JP); Toshiaki Iwa, Tokyo (JP); Yoshihiro Ogawa, Tokyo (JP); Yusuke Sato, Tokyo (JP)

(73) Assignees: TOYOTA JIDOSHA KABUSHIKI KAISHA, Toyota (JP); DENSO CORPORATION, Kariya (JP); EAGLE INDUSTRY CO., LTD., Tokyo (JP)

( * ) Notice: Subject to any disclaimer, the term of this patent is extended or adjusted under 35 U.S.C. 154(b) by 204 days.

(21) Appl. No.: 15/748,440

(22) PCT Filed: Jul. 28, 2016

(86) PCT No.: PCT/IB2016/001067
§ 371 (c)(1),
(2) Date: Jan. 29, 2018

(87) PCT Pub. No.: WO2017/021769
PCT Pub. Date: Feb. 9, 2017

(65) Prior Publication Data

US 2018/0223782 A1 Aug. 9, 2018

(30) Foreign Application Priority Data

Jul. 31, 2015 (JP) ..... 2015-152622

(51) Int. Cl.
*F02M 55/04* (2006.01)
*F02M 37/00* (2006.01)
*F04B 11/00* (2006.01)

(52) U.S. Cl.
CPC ..... *F02M 55/04* (2013.01); *F02M 37/0041* (2013.01); *F04B 11/0016* (2013.01); *F02M 2200/26* (2013.01); *F02M 2200/315* (2013.01)

(58) Field of Classification Search
CPC ..... F02M 2200/26; F02M 2200/315; F02M 37/0041; F02M 55/04; F02M 59/102;
(Continued)

(56) References Cited

U.S. PATENT DOCUMENTS 7,124,738 B2 10/2006 Usui et al.
7,398,768 B2 * 7/2008 Usui ..... F02D 41/20 123/446

(Continued)

FOREIGN PATENT DOCUMENTS

EP 1775459 A1 4/2007
JP 2007-218264 A 8/2007

(Continued)

*Primary Examiner* — Devon C Kramer
*Assistant Examiner* — Benjamin Doyle
(74) *Attorney, Agent, or Firm* — Oliff PLC

(57) ABSTRACT

A damper device is provided in a flow passage of a fluid. The damper device includes a plurality of diaphragm dampers that are stacked together. Each of the plurality of diaphragm dampers includes a first flexible portion, a second flexible portion, and a rim including a welded portion. A peripheral edge of the first flexible portion and a peripheral edge of the second flexible portion are welded together in the welded portion. Each of the plurality of diaphragm dampers is
(Continued)

configured to seal a gas in an inner region between the first flexible portion and the second flexible portion. A coupler that couples the plurality of diaphragm dampers together includes holders that hold the rims of the plurality of diaphragm dampers. A gap is provided between the holder of the coupler and the welded portion of each of the plurality of diaphragm dampers.

4 Claims, 6 Drawing Sheets

(58) Field of Classification Search
CPC .... F02M 59/366; F02M 59/367; F02M 59/44; F02M 59/06; F02M 59/442; F02M 59/48; F02M 63/0225; F02M 59/02; F02M 2200/09; F02M 2200/24; F02M 2200/8084; F02M 2200/9015; F02M 53/00; F02M 59/462; F02M 63/0017; F02M 63/0035; F02M 63/005; F02M 63/0054; F02M 63/0056; F02M 63/024; F02M 63/0245; F02M 63/0265; F02M 63/028; F04B 11/0016; F04B 11/0008; F04B 53/001; F04B 11/0091; F04B 1/0408; F04B 1/0421; F04B 43/02; F04B 53/143; F04B 11/00; F04B 11/0033; F04B 1/0404; F04B 1/0448; F04B 1/0452; F04B 1/053; F04B 35/01; F04B 53/003; F04B 53/004; F04B 7/0015; F04B 7/02; F04B 9/042; F04B 37/12; F16L 55/04; F16L 55/0338; F16L 55/05; F16L 55/053; B23D 59/006; B27B 21/04; B60T 8/4068; B60T 8/42; F02D 2041/2027; F02D 2041/2058; F02D 41/20
USPC ..... 417/540
See application file for complete search history.

(56) References Cited

U.S. PATENT DOCUMENTS 8,317,501 B2 * 11/2012 Inoue ..... F04B 37/12 417/540
8,393,881 B2 * 3/2013 Usui ..... F02M 55/04 417/540
8,672,653 B2 * 3/2014 Mancini ..... F02M 55/04 123/447
2005/0019188 A1 * 1/2005 Usui ..... F02M 55/04 417/540
2008/0056914 A1 * 3/2008 Usui ..... F02M 55/04 417/307
2008/0175735 A1 * 7/2008 Lucas ..... F02M 37/0041 417/540
2008/0289713 A1 * 11/2008 Munakata ..... F02M 55/04 138/26
2011/0017332 A1 * 1/2011 Bartsch ..... B60T 8/4068 138/30
2011/0103985 A1 * 5/2011 Mancini ..... F02M 55/04 417/540
2011/0108007 A1 * 5/2011 Mancini ..... F04B 53/143 123/495
2011/0110807 A1 * 5/2011 Kobayashi ..... F02M 59/102 417/540
2011/0110809 A1 * 5/2011 Inoue ..... F02M 55/04 417/559
2012/0006303 A1 * 1/2012 Usui ..... F02M 55/04 123/495
2012/0087817 A1 * 4/2012 Lucas ..... F04B 1/0404 417/540
2012/0195778 A1 * 8/2012 Koga ..... F04B 1/0408 417/540
2013/0052064 A1 * 2/2013 Oikawa ..... F04B 11/0016 417/540
2013/0209289 A1 * 8/2013 Lucas ..... F04B 11/0008 417/395
2013/0230417 A1 * 9/2013 Kobayashi ..... F04B 11/0008 417/395
2013/0266465 A1 * 10/2013 Akita ..... F02M 53/00 417/443
2013/0276929 A1 * 10/2013 Oikawa ..... F16L 55/04 138/26
2015/0017040 A1 * 1/2015 Hishinuma ..... F02M 59/367 417/540
2016/0169173 A1 6/2016 Yabuuchi

FOREIGN PATENT DOCUMENTS

JP 2008-014319 A 1/2008
JP 2013-227877 A 11/2013
JP 2015-021468 A 2/2015
WO 2008/086012 A1 7/2008
WO 2012/047283 A2 4/2012

* cited by examiner

DAMPER DEVICE WITH A PLURALITY OF STACKED DIAPHRAGMS COUPLED TOGETHER BY A COUPLER HAVING HOLDERS FORMING A SPACE PROVIDED BETWEEN A PERIPHERAL WELD OF THE DIAPHRAGMS AND THE COUPLER

BACKGROUND OF THE INVENTION

1. Field of the Invention

The invention relates to a damper device.

2. Description of Related Art

Japanese Patent Application Publication No. 2007-218264 (JP 2007-218264 A) discloses a damper device provided in a high-pressure fuel pump or the like. Two diaphragm dampers are disposed in a stacked state for preventing the pressure pulsation of fuel in the damper device. The damper device described in JP 2007-218264 A reduces the pressure pulsation of the fuel in the high-pressure fuel pump by bending of the diaphragm dampers according to the pressure of the fuel in the high-pressure fuel pump. Each diaphragm damper has a welded portion where the peripheral edges of two diaphragms are welded together and a gas is sealed in an inner region between the diaphragms. This damper device is configured such that a washer guide fixed to the high-pressure fuel pump is in contact with one side surface of the peripheral portion of each diaphragm damper. An annular washer is pressed against the other side surface thereof, thereby holding the peripheral portion of each diaphragm damper by sandwiching it between the washer and the washer guide.

SUMMARY OF THE INVENTION

In the damper device including the plurality of diaphragm dampers as described above, when the diaphragm dampers are independently mounted to the high-pressure fuel pump, the number of mounting steps becomes large so that the mounting efficiency of the diaphragm dampers is difficult to improve. In this regard, when the diaphragm dampers are coupled together by a coupler in advance and then are attached as one unit to the high-pressure fuel pump, the mounting efficiency of the diaphragm dampers is expected to be improved. However, when the peripheral portions of the diaphragm dampers are in contact with the coupler, there is a possibility that the durability of the welded portions may decrease due to rubbing caused by such contact.

The invention provides a damper device that, while improving the mounting efficiency of stacked diaphragm dampers, prevents a reduction in the durability of welded portions of the respective diaphragm dampers.

According to one aspect of the invention, a damper device provided in a flow passage of a fluid is provided. The damper device includes: a plurality of diaphragm dampers that are stacked together; and a coupler that couples the plurality of diaphragm dampers together. Each of the plurality of diaphragm dampers includes a first flexible portion, a second flexible portion, and a rim. The rim includes a welded portion; a peripheral edge of the first flexible portion and a peripheral edge of the second flexible portion that are welded together in the welded portion. Each of the plurality of diaphragm dampers is configured to seal a gas in an inner region between the first flexible portion and the second flexible portion. The coupler includes holders that hold the rims of the plurality of diaphragm dampers. A gap is provided between the holder of the coupler and the welded portion of each of the plurality of diaphragm dampers.

According to the above described aspect, since the stacked diaphragm dampers are coupled together by the coupler, when mounting the diaphragm dampers, it is possible to handle the diaphragm dampers as one unit. Further, since the gap is provided between the holder of the coupler and the welded portion of each of the diaphragm dampers, it is possible to avoid a contact between the welded portion and the holder. Therefore, the damper device of the above-described configuration can, while improving the mounting efficiency of the stacked diaphragm dampers, prevent a reduction in the durability of the welded portions of the respective diaphragm dampers.

According to the above mentioned aspect, a length of the holder is greater than a length of the rim of each of the plurality of diaphragm dampers in a radial direction of the plurality of diaphragm dampers in a cross section including a central axis. The central axis is a virtual straight line passing through respective centers of the plurality of diaphragm dampers in a stacked state:

According to the configuration described above, since the length of the holder of the coupler is set to be greater than the length of the rim of the diaphragm damper, the gap between the holder and the welded portion of the diaphragm damper can be ensured more stably.

According to the above mentioned aspect, the holder includes a first contact portion and a second contact portion. The first contact portion includes a distal end being in contact with the first flexible portion, and the second contact portion includes a distal end being in contact with the second flexible portion. A distance between the first contact portion and the rim of each of the plurality of diaphragm dampers and a distance between the second contact portion and the rim of each of the plurality of diaphragm dampers each increase from a radially inner side toward a radially outer side of the plurality of diaphragm dampers.

According to the configuration described above, contact portions between the holder of the coupler and the first and second flexible portions forming the rim of the diaphragm damper are limited so that it is possible to easily avoid a contact between the holder and the rim at portions other than such contact portions. Therefore, even if the damper device vibrates, it is possible to prevent the occurrence of abnormal noise caused by a contact therebetween at portions other than such contact portions.

According to the above mentioned aspect, a plurality of the couplers is provided in a circumferential direction of the plurality of diaphragm dampers. According to the configuration described above, the configuration as one unit of the diaphragm dampers and the couplers is stabilized and thus is easy to handle, and therefore, it is possible to further improve the mounting efficiency of the diaphragm dampers.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
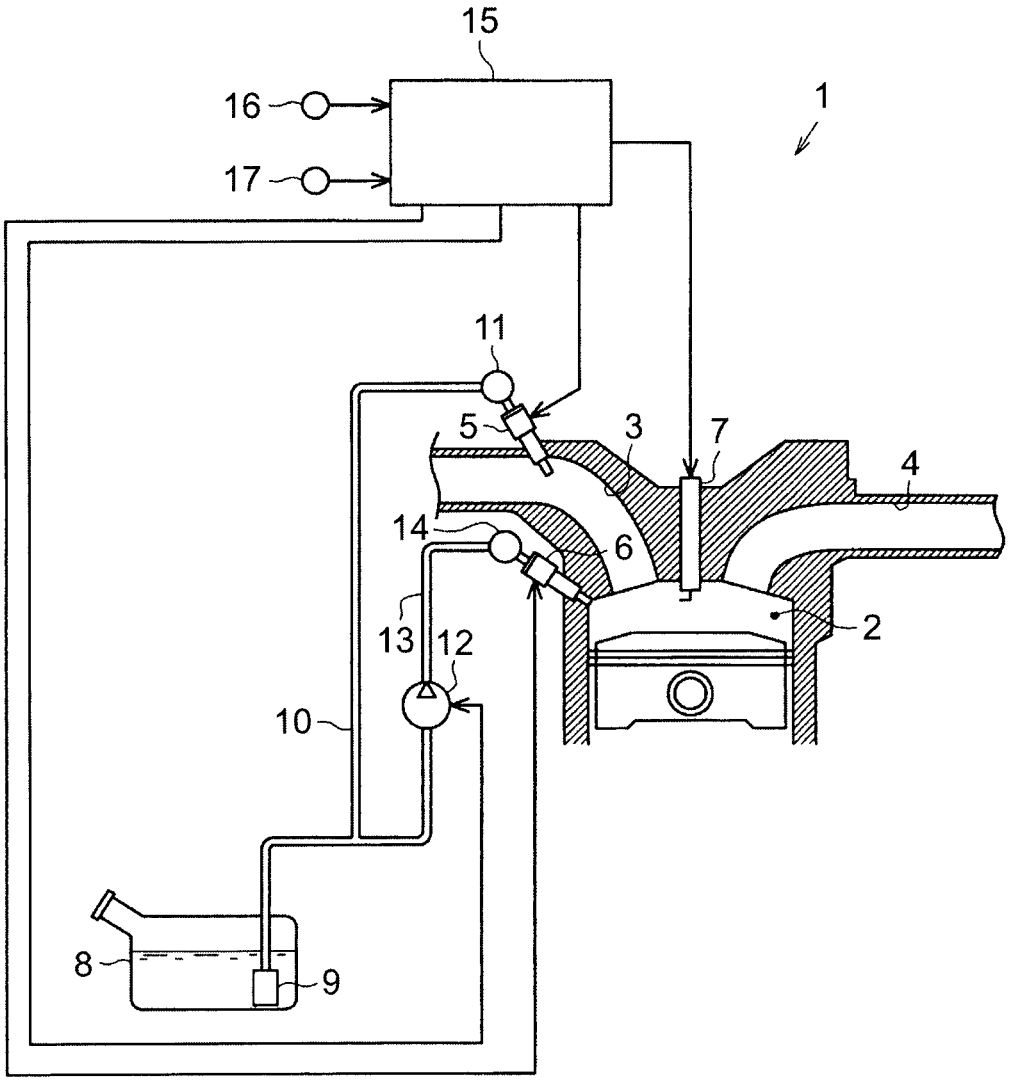
FIG. 1 is a schematic configuration diagram of an internal combustion engine.

An embodiment of a damper device will be described with reference to FIG. 1 to FIG. 8. As shown in FIG. 1, an internal combustion engine 1 including the damper device has intake passages 3 and exhaust passages 4 that are connected to combustion chambers 2. A port injection valve 5 that injects fuel into the intake passage 3 is disposed in each intake passage 3. An in-cylinder injection valve 6 that injects fuel into the combustion chamber 2 and a spark plug 7 are disposed in each combustion chamber 2.

The internal combustion engine 1 has a fuel tank 8 storing the fuel that is injected from the port injection valves 5 and the in-cylinder injection valves 6. The fuel tank 8 is provided therein with a feed pump 9 that pumps out the fuel stored in the fuel tank 8. A low-pressure fuel passage 10 is connected to the feed pump 9 and the port injection valves 5 are connected to the low-pressure fuel passage 10 via a low-pressure fuel pipe 11.

The low-pressure fuel passage 10 branches on the way and the branch low-pressure fuel passage 10 is connected to a high-pressure fuel pump 12. A high-pressure fuel passage 13 is connected to the high-pressure fuel pump 12. The high-pressure fuel pump 12 further pressurizes the fuel pumped out from the feed pump 9 and discharges the pressurized fuel into the high-pressure fuel passage 13. The in-cylinder injection valves 6 are connected to the high-pressure fuel passage 13 via a high-pressure fuel pipe 14.

The internal combustion engine 1 is connected to an electronic control unit 15. Detection signals from various sensors are input to the electronic control unit 15. The sensors are, for example, an accelerator sensor 16 for detecting an operation amount of an accelerator pedal, a rotation speed sensor 17 for detecting an engine speed, and so on. Based on the detection results of the sensors 16 and 17 and so on, the electronic control unit 15 controls driving of the actuators provided at the respective portions of the internal combustion engine 1, such as the port injection valves 5, the in-cylinder injection valves 6, the spark plugs 7, and the high-pressure fuel pump 12. That is, the electronic control unit 15 performs a fuel injection control that controls injection modes of the port injection valves 5 and the in-cylinder injection valves 6 based on an engine operating condition, thereby determining injection modes of the fuel from the port injection valves 5 and the in-cylinder injection valves 6. Further, the electronic control unit 15 adjusts the amount of the fuel supplied to the in-cylinder injection valves 6 by controlling the high-pressure fuel pump 12.

Figure 2:
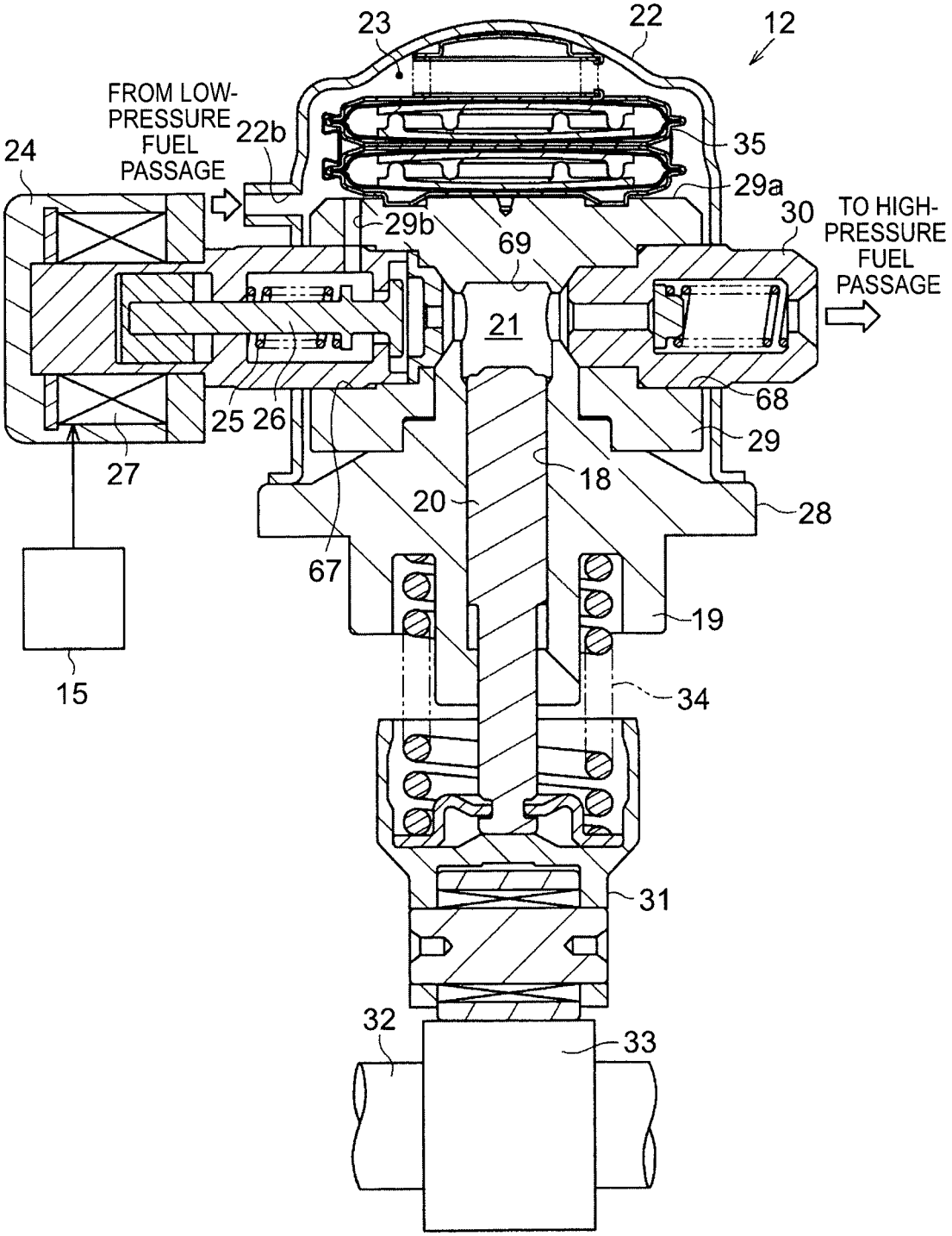
FIG. 2 is a sectional view of a high-pressure fuel pump provided in the internal combustion engine.

Next, the configuration of the high-pressure fuel pump 12 will be described. As shown in FIG. 2, the high-pressure fuel pump 12 includes a first housing 19 provided therein with a tubular cylinder 18. An upper end portion of the first housing 19 protrudes more upward on its central side where the cylinder 18 is provided. The first housing 19 is formed with a flange 28 protruding in a radial direction of the cylinder 18. A cylindrical rod-shaped plunger 20 is disposed in the cylinder 18 so as to be reciprocatingly slidable. The plunger 20 has one end side disposed in the cylinder 18 and the other end side protruding outward of the first housing 19 from the cylinder 18.

A generally hollow-cylindrical lifter 31 is fixed to a lower end portion of the plunger 20. A cam 33 fixed to a camshaft 32 of the internal combustion engine 1 is in contact with a lower end portion of the lifter 31. A coil spring 34 in a compressed state is fixed between the first housing 19 and the lifter 31 so that a force is acting on the lifter 31 by the coil spring 34 in a direction of pushing it downward. With the rotation of the cam 33, a force that pushes the lifter 31 upward against the biasing force of the coil spring 34 acts intermittently on the lifter 31. Therefore, the plunger 20 fixed to the lifter 31 slidingly reciprocates up and down in the cylinder 18 with the rotation of the cam 33.

A second housing 29 is fixed to the upper end portion of the first housing 19. The second housing 29 is formed at its lower end portion with a recess 69 opened downward and the upper end portion of the first housing 19 is fitted into the recess 69. The depth of the recess 69 is set such that the plunger 20 is not brought into contact with the second housing 29 when the plunger 20 is located at its uppermost position. Therefore, in the state where the first housing 19 and the second housing 29 are assembled together, a pressurizing chamber 21 is defined by the cylinder 18, the plunger 20, and the recess 69.

A case 22 covering the second housing 29 is attached to the flange 28 of the first housing 19. In a vertical direction in FIG. 2, the height of the case 22 is greater than the height of the second housing 29. Therefore, a space is defined between the case 22 and an upper end face 29*a* of the second housing 29. The fuel is supplied to this space from the low-pressure fuel passage 10. Hereinafter, this space will be referred to as a fuel chamber 23. The case 22 has a connection port 22*b* on its side. The connection port 22*b* is connected to the low-pressure fuel passage 10 so that the fuel flows into the fuel chamber 23 through the connection port 22*b*.

Fitting holes 67 and 68 each extending in a direction (lateral direction in FIG. 2) perpendicular to an axial direction of the cylinder 18 (vertical direction in FIG. 2) are formed at side portions of the second housing 29. The fitting holes 67 and 68 face each other with the pressurizing chamber 21 interposed therebetween. The second housing 29 has a communication hole 29*b* establishing communication between the fitting hole 67 and the fuel chamber 23. An electromagnetic spill valve 24 is fittingly inserted into the fitting hole 67 formed at the side portion of the second housing 29. The case 22 is formed, at a position facing the fitting hole 67, with a hole through which the electromagnetic spill valve 24 is inserted. The electromagnetic spill valve 24 is formed with communication passages respectively establishing communication between a space formed inside and the pressurizing chamber 21 and between this space and the communication hole 29*b*. That is, the electromagnetic spill valve 24 forms a fuel flow passage connecting between the fuel chamber 23 and the pressurizing chamber 21.

The electromagnetic spill valve 24 has a spring 25 that constantly biases a valve element 26 in a valve opening direction (rightward in FIG. 2). An electromagnetic solenoid 27 is incorporated in the electromagnetic spill valve 24. The electromagnetic solenoid 27 generates a magnetic force when energized and moves the valve element 26 in a valve closing direction (leftward in FIG. 2) against the biasing force of the spring 25. Therefore, when the electromagnetic solenoid 27 is in the energized state, the valve element 26 closes so that the fuel flow passage between the fuel chamber 23 and the pressurizing chamber 21 is closed. On the other hand, when the electromagnetic solenoid 27 is in a non-energized state, the valve element 26 opens so that the fuel flow passage between the fuel chamber 23 and the pressurizing chamber 21 is opened.

A check valve 30 is fittingly inserted into the fitting hole 68 formed at the side portion of the second housing 29. The case 22 is formed, at a position facing the fitting hole 68, with a hole through which the check valve 30 is inserted. The check valve 30 is formed with communication passages respectively establishing communication between a space formed inside and the pressurizing chamber 21 and between this space and the high-pressure fuel passage 13. That is, the check valve 30 forms a fuel flow passage connecting between the pressurizing chamber 21 and the high-pressure fuel passage 13. The check valve 30 is a pressure-sensitive check valve and opens when the fuel pressure in the pressurizing chamber 21 becomes a predetermined discharge start pressure or higher. Consequently, the fuel is discharged from the pressurizing chamber 21 into the high-pressure fuel passage 13.

By controlling the energization of the electromagnetic spill valve 24, the electronic control unit 15 adjusts the amount of the fuel discharged from the high-pressure fuel pump 12 into the high-pressure fuel passage 13. That is, by setting the electromagnetic solenoid 27 to the non-energized state when the plunger 20 descends, the fuel flow passage leading from the fuel chamber 23 to the pressurizing chamber 21 via the communication hole 29*b* and the communication passages in the electromagnetic spill valve 24 is opened so that the fuel is sucked from the fuel chamber 23 into the pressurizing chamber 21. Then, by setting the electromagnetic solenoid 27 to the energized state when the plunger 20 ascends, the fuel flow passage between the fuel chamber 23 and the pressurizing chamber 21 is closed so that the fuel in the pressurizing chamber 21 is pressurized in that state. Then, when the fuel pressure in the pressurizing chamber 21 reaches the predetermined discharge start pressure or higher, the fuel is discharged from the pressurizing chamber 21 into the high-pressure fuel passage 13. It is to be noted that, by maintaining the fuel flow passage between the pressurizing chamber 21 and the fuel chamber 23 in the opened state for a while after the plunger 20 starts to ascend, it is possible to adjust the fuel amount in the pressurizing chamber 21 by discharging the fuel sucked into the pressurizing chamber 21 back to the fuel chamber 23 side again. In this way, the electronic control unit 15 adjusts the fuel amount discharged into the high-pressure fuel passage 13 by controlling the high-pressure fuel pump 12.

Figure 3:
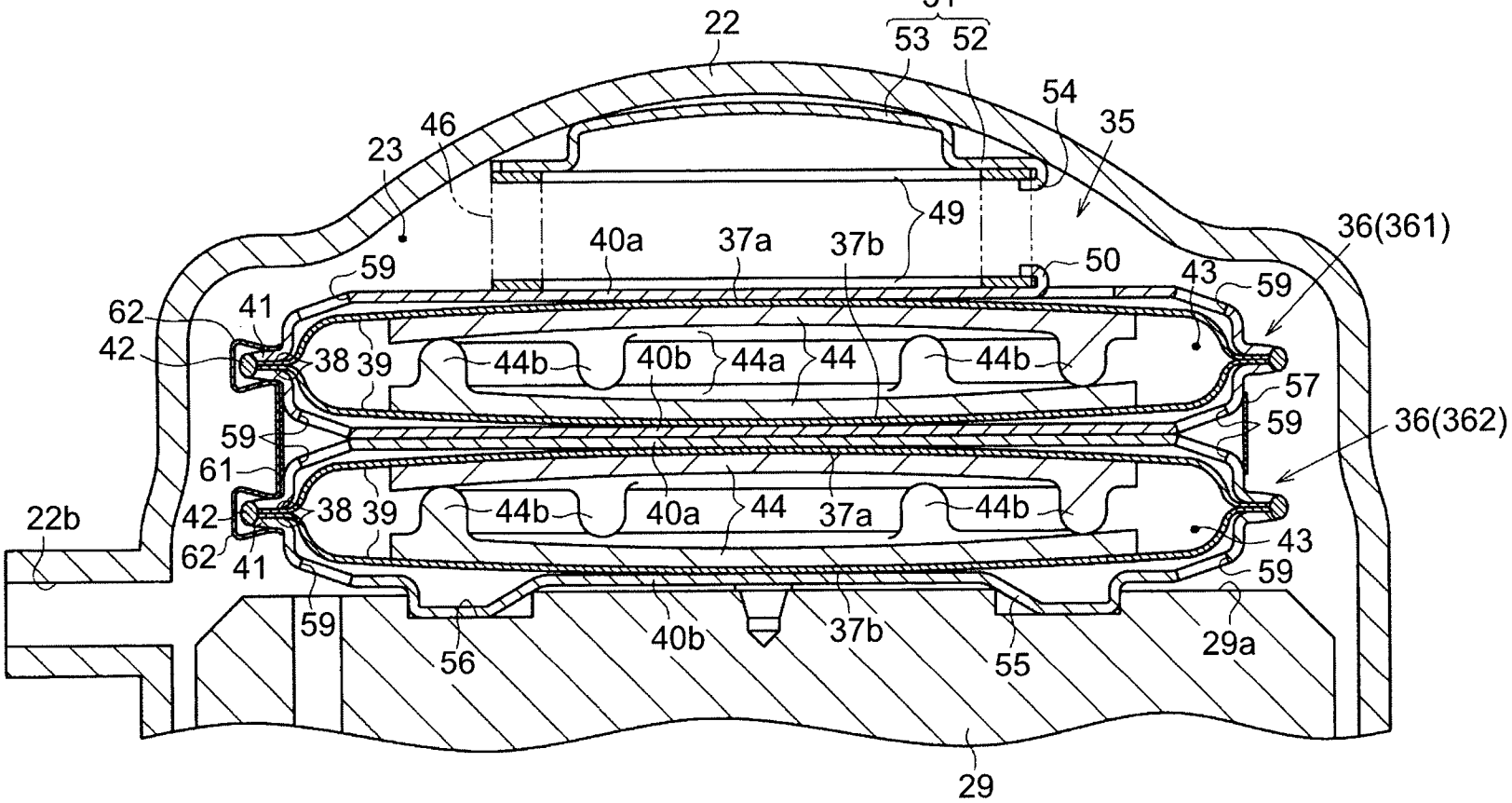
FIG. 3 is a sectional view of a damper device.

Next, the configuration of a damper device 35 will be described. As shown in FIG. 3, the damper device 35 is disposed in the fuel chamber 23. The damper device 35 reduces the pressure pulsation of the fuel caused by the suction of the fuel from the fuel chamber 23 into the pressurizing chamber 21 and the discharge-back of the fuel from the pressurizing chamber 21 into the fuel chamber 23. The damper device 35 includes two stacked diaphragm dampers 36. Since the diaphragm dampers 36 have the same configuration, the configuration of the diaphragm damper 361 located on the upper side will be described hereinbelow, while a description of the configuration of the diaphragm damper 362 located on the lower side will be omitted by assigning the same reference symbols thereto.

The diaphragm damper 36 has a pair of disk-shaped diaphragms 37*a* and 37*b*. Each diaphragm 37*a*, 37*b* is in the form of a metal plate and has flexibility. Each diaphragm 37*a*, 37*b* has a central portion 39 bulging in a curve in cross section and a flat end portion 38 formed around the central portion 39. The diaphragms 37*a* and 37*b* are disposed such that the central portions 39 bulge away from each other, while the end portions 38 are in contact with each other.

The diaphragm damper 36 has a pair of disk-shaped cover members 40*a* and 40*b*. The cover members 40*a* and 40*b* have a shape similar to that of the diaphragms 37*a* and 37*b* and respectively cover the diaphragms 37*a* and 37*b*. Compared to the diaphragms 37*a* and 37*b*, the cover members 40*a* and 40*b* are each in the form of a thicker metal plate and are increased in rigidity.

The end portions 38 of the diaphragms 37*a* and 37*b* are sandwiched between the pair of cover members 40*a* and 40*b* in the state where the end portions 38 are in contact with each other. With this configuration, a rim 41 of the diaphragm damper 36 is formed. The peripheral edge of the rim 41 is welded along its entire periphery. That is, a welded portion 42 where the peripheral edges of the end portions 38 of the diaphragms 37*a* and 37*b* and the peripheral edges of the cover members 40*a* and 40*b* are welded together is formed along the peripheral edge of the diaphragm damper 36. As a welding means, it is possible to use, for example, laser welding. In the diaphragm damper 36, a first flexible portion is formed by the diaphragm 37*a* and the cover member 40*a* and a second flexible portion is formed by the diaphragm 37*b* and the cover member 40*b*. A gas is sealed in an inner region 43 defined between the diaphragm 37*a* of the first flexible portion and the diaphragm 37*b* of the second flexible portion. In the state shown in FIG. 3, a part of the central portion 39 of each diaphragm 37*a*, 37*b* is in contact with an inner surface of the cover member 40*a*, 40*b*.

The upper cover member 40*a* of the diaphragm damper 361 disposed on the upper side is in contact with a coiled wave spring 46, while the lower cover member 40*b* thereof is in contact with the upper cover member 40*a* of the diaphragm damper 362 disposed on the lower side. The lower cover member 40*b* of the diaphragm damper 362 disposed on the lower side has a locking lug 55 protruding outward. The locking lug 55 is locked with a recessed groove 56 formed on the upper end face 29*a* of the second housing 29.

The cover members 40*a* and 40*b* of the diaphragm damper 36 are each formed with a plurality of communication holes 59. The fuel in the fuel chamber 23 flows into between the cover member 40*a*, 40*b* and the diaphragm 37*a*, 37*b* through the communication holes 59. Consequently, the pressure in the fuel chamber 23 acts on the diaphragms 37*a* and 37*b*.

The upper cover member 40*a* of the diaphragm damper 361 disposed on the upper side has a plurality of claws 50 arranged at regular intervals in its circumferential direction. The claws 50 are formed by, for example, punching.

Two support members 44 having elasticity are disposed in the inner region 43 of the diaphragm damper 36. The support members 44 each have a disk-shaped base plate 44*a* and outer surfaces of the base plates 44*a* are respectively in contact with the diaphragms 37*a* and 37*b* adjacent thereto. A plurality of projections 44*b* are provided on the peripheral side of an inner surface of each base plate 44*a*. The projections 44*b* provided to the upper base plate 44*a* are in contact with the inner surface of the lower base plate 44*a*, while the projections 44*b* provided to the lower base plate 44*a* are in contact with the inner surface of the upper base plate 44*a*. The central portions 39 of the diaphragms 37*a* and 37*b* are supported by the two support members 44.

Figure 4:
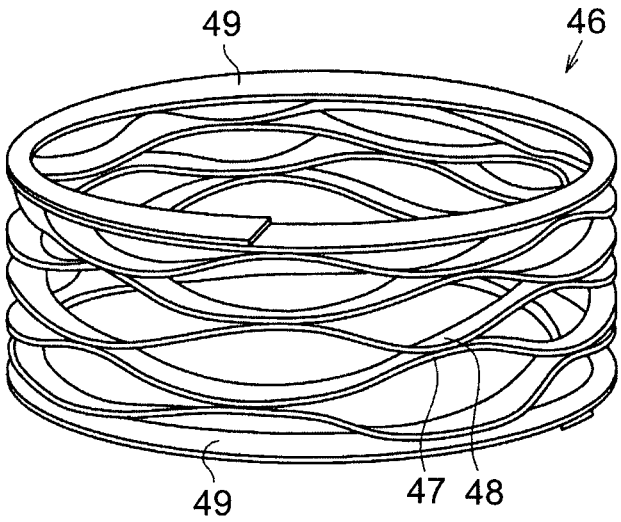
FIG. 4 is a perspective view of a coiled wave spring.

The coiled wave spring 46 shown in FIG. 4 is disposed on an upper surface of the diaphragm damper 361. The coiled wave spring 46 is formed by spirally winding a rectangular wire made of a spring material and has a hollow cylindrical shape on the whole. In the coiled wave spring 46, end turn portions 49 correspond to a winding start turn and a winding end turn each. The end portions 49 form a flat coil and a portion between the end turn portions 49 forms a corrugated coil. At the corrugated coil portion, mountain portions 47 and valley portions 48 of the coil are in contact with each other.

Figure 5:
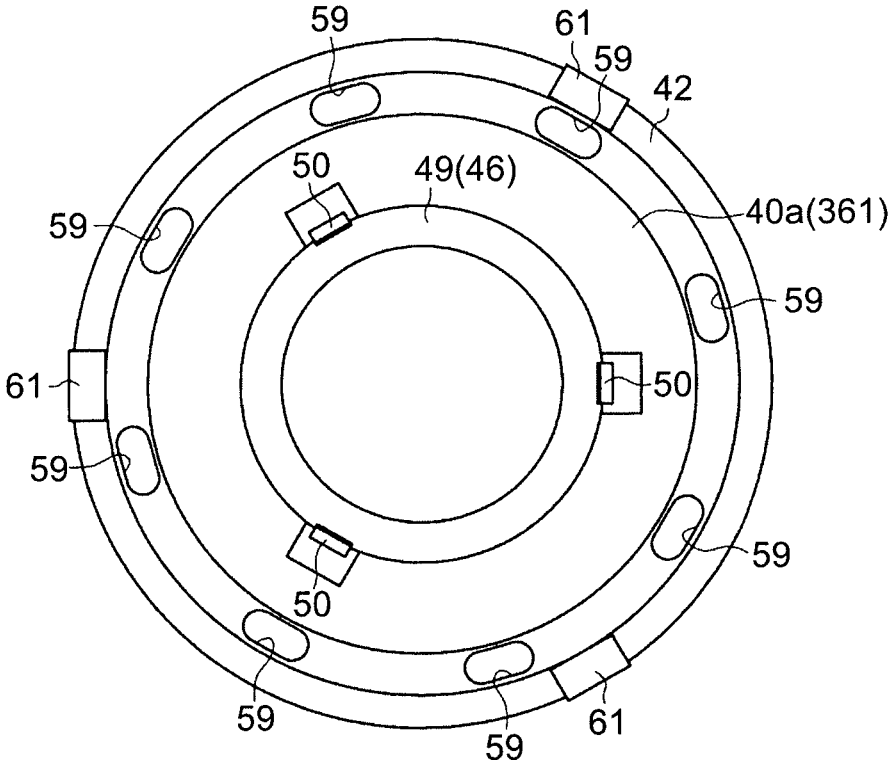
FIG. 5 is a top view of the damper device.
Figure 6:
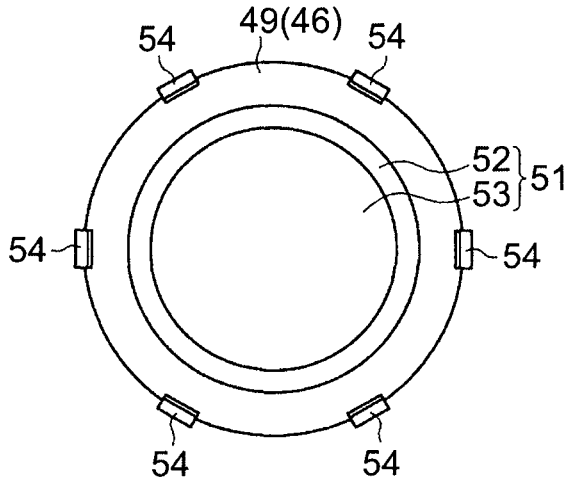
FIG. 6 is a plan view showing a fixing manner of one end portion of the coiled wave spring.

As shown in FIG. 3 and FIG. 5, the lower side of the coiled wave spring 46 is fixed to the diaphragm damper 361. The lower end turn portion 49 of the coiled wave spring 46 is fastened by caulking the claws 50 of the upper cover member 40*a* of the diaphragm damper 361 disposed on the upper side. As shown in FIG. 3 and FIG. 6, the upper end turn portion 49 of the coiled wave spring 46 is fixed to an attaching member 51 disposed adjacent thereto on the upper side.

As shown in FIG. 3 and FIG. 6, the attaching member 51 has a disk shape with a diameter substantially equal to that of the end turn portion 49. As shown in FIG. 3, a large-diameter portion 52 forming a peripheral portion is placed on the end turn portion 49 of the coiled wave spring 46, while a small-diameter portion 53 forming a central portion protrudes upward and is curved along an inner peripheral surface of the case 22. The large-diameter portion 52 is provided in its circumferential direction with a plurality of claws 54 extending radially. As shown in FIG. 3 and FIG. 6, the claws 54 of the attaching member 51 are bent toward the end turn portion 49 of the coiled wave spring 46, thereby fastening the end turn portion 49 by caulking.

As shown in FIG. 3, the diaphragm dampers 36 are placed on the upper end face 29*a* of the second housing 29 of the high-pressure fuel pump 12. The case 22 is fixed to the first housing 19 while pressing the attaching member 51 from the upper side. Therefore, the coiled wave spring 46 is compressed between the case 22 and the diaphragm dampers 36 so that the diaphragm dampers 36 are pressed against the second housing 29 side by an elastic force of the coiled wave spring 46. In this way, the diaphragm dampers 36 are held in the fuel chamber 23.

Figure 7:
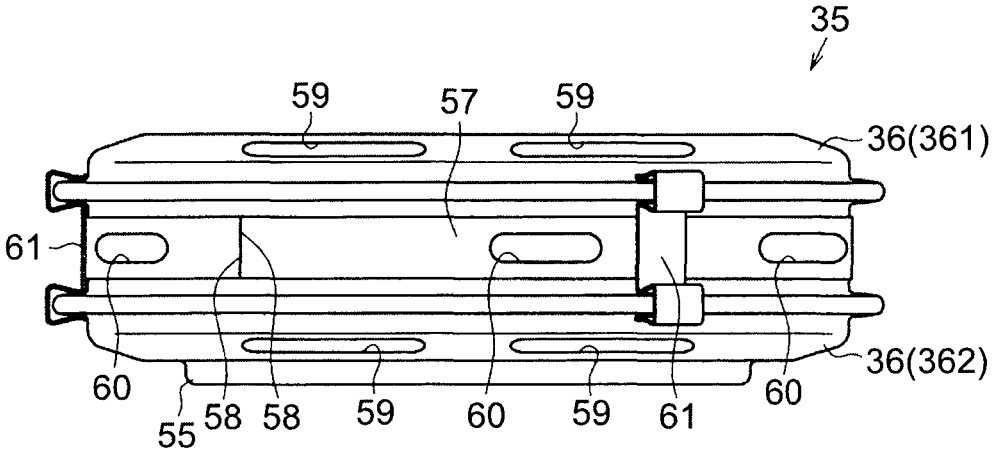
FIG. 7 is a side view of the damper device.

As shown in FIG. 7, the damper device 35 includes a holder band 57 for preventing misalignment between the diaphragm dampers 36. The holder band 57 is a band plate made of a metal and is wound around side surfaces of the diaphragm dampers 36 while spanning the diaphragm dampers 36. The holder band 57 is attached to the diaphragm dampers 36, for example, by welding its end portions 58 together. The holder band 57 is formed with a plurality of through-holes 60. Therefore, the fuel in the fuel chamber 23 can flow inward and outward of the holder band 57 through the through-holes 60 of the holder band 57.

Figure 8:
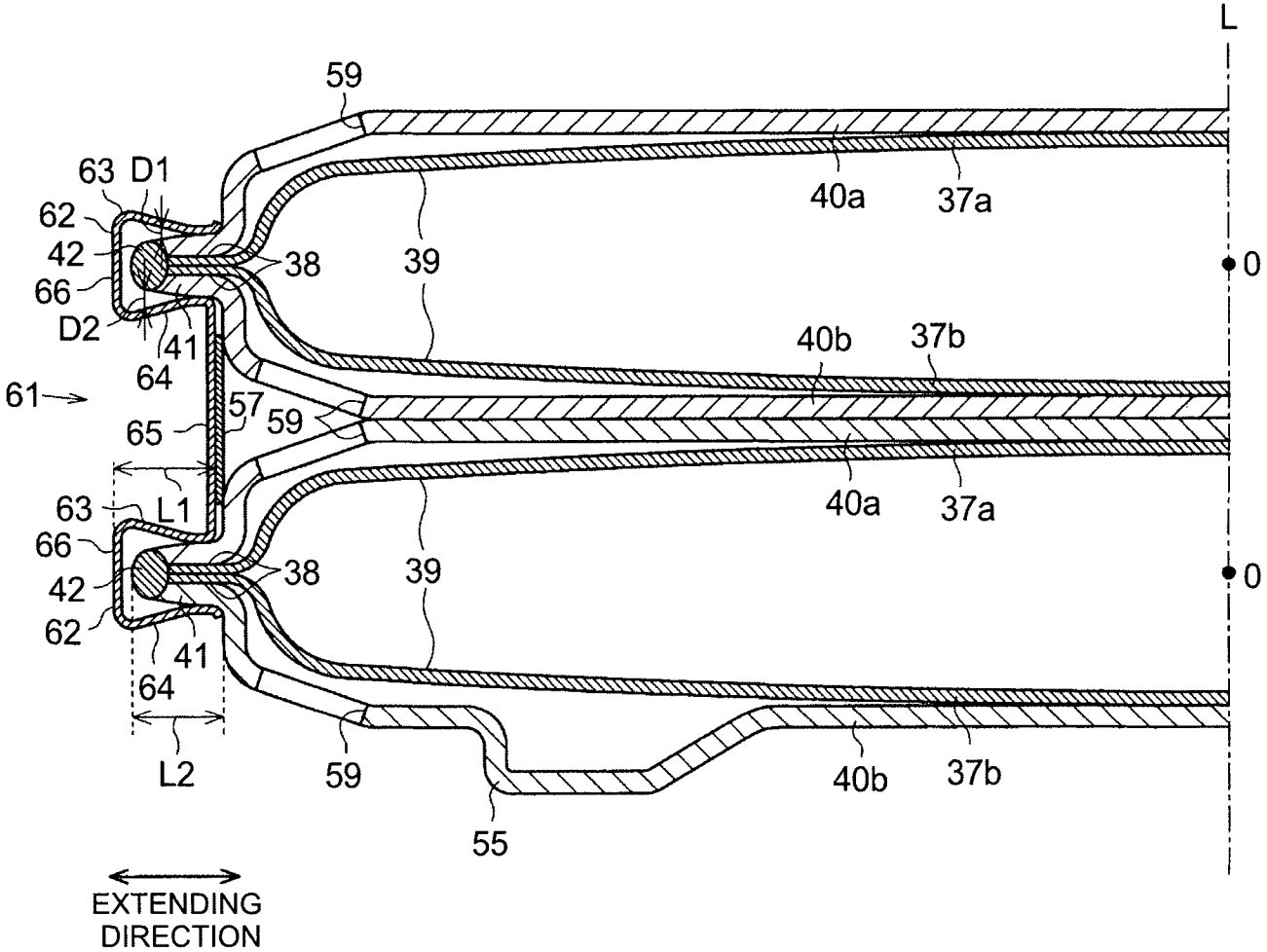
FIG. 8 is an enlarged sectional view of a coupler provided to diaphragm dampers.

The damper device 35 includes couplers 61 each coupling the stacked diaphragm dampers 36 to each other. As shown in FIG. 8, each coupler 61 is made of a metal and has holders 62. Each holder 62 is configured to hold the rim 41 of the diaphragm damper 36 in such a way that a gap is formed between the holder 62 and the welded portion 42. Each holder 62 includes a first contact portion 63 having a distal end being in contact with the cover member 40*a* (first flexible portion) and a second contact portion 64 having a distal end being in contact with the cover member 40*b* (second flexible portion). The first contact portion 63 and the second contact portion 64 have proximal ends that are connected together by a connecting portion 66. The holders 62 respectively holding the rims 41 of the upper and lower diaphragm dampers 36 are connected together by a connecting portion 65.

It is assumed that a virtual straight line passing through the centers O of the stacked diaphragm dampers 36 is a central axis L. In this case, in an extending direction of the rim 41 of the diaphragm damper 36 in a cross section including the central axis L, a length L1 of the holder 62 is greater than a length L2 of the rim 41 (L1>L2). The center O is a middle point of a segment connecting the centers of the disk-shaped diaphragms 37*a* and 37*b*.

The first contact portion 63 and the second contact portion 64 are each in contact with a portion, located on the inner peripheral side (the center O side) of the diaphragm damper 36 with respect to the welded portion 42, of the rim 41. The first contact portion 63 and the second contact portion 64 are inclined to the rim 41 such that a distance D1 between the first contact portion 63 and the rim 41 and a distance D2 between the second contact portion 64 and the rim 41 gradually increase from the inner peripheral side toward the outer peripheral side of the diaphragm damper 36 in the extending direction of the rim 41. As shown in FIG. 7, the plurality of couplers 61 is provided in the circumferential direction of the diaphragm dampers 36.

The coupler 61 can be attached to the diaphragm dampers 36, for example, in the following manner. First, forces are exerted on the holder 62 in directions to move the distal end side of the first contact portion 63 and the distal end side of the second contact portion 64 away from each other, thereby elastically deforming the holder 62. Then, the rim 41 is inserted between the first contact portion 63 and the second contact portion 64. Thereafter, the forces exerted on the holder 62 are released, thereby elastically restoring the holder 62. Consequently, the first contact portion 63 and the second contact portion 64 are pressed against the rim 41 in vertical directions, thereby holding the rim 41 therebetween. By attaching each holder 62 to the corresponding rim 41 in this way, the coupler 61 can couple the stacked diaphragm dampers 36 together.

Next, the actions and effects of this embodiment will be described. The volume in the fuel chamber 23 changes due to bending of the diaphragms 37*a* and 37*b* according to the pressure of the fuel. By this volume change in the fuel chamber 23, the pressure pulsation of the fuel that can occur in the fuel flow passage from the fuel chamber 23 to the pressurizing chamber 21 is prevented by the diaphragm damper 36. In particular, since the two diaphragm dampers 36 are provided in the stacked state, the pressure pulsation of the fuel is prevented efficiently.

The two diaphragm dampers 36 are coupled together in the stacked state by the coupler 61. Therefore, when mounting the plurality of diaphragm dampers 36 to the high-pressure fuel pump 12 in the stacked state, it is possible to handle the stacked diaphragm dampers 36 as one unit so that the mounting efficiency of the stacked diaphragm dampers 36 is improved.

The holder 62 of the coupler 61 is attached to the rim 41 in the state where a gap is formed between the holder 62 and the welded portion 42 of the diaphragm damper 36. Therefore, a contact between the holder 62 and the welded portion 42 is avoided so that it is prevented that the coupler 61 rubs against the welded portion 42 to scrape off the welded portion 42 and that metal abrasion powder is generated and mixed into the fuel.

Since the length L1 of the holder 62 is greater than the length L2 of the rim 41 (L1>L2), the gap between the holder 62 and the welded portion 42 of the diaphragm damper 36 is ensured more stably. That is, as shown in FIG. 8, even when the holder 62 is attached to hold the innermost peripheral side portions of the rim 41, the holder 62 and the welded portion 42 are hardly brought into contact with each other.

Even if an external force is exerted to push the coupler 61 toward the inner peripheral side (the center O side) of the diaphragm damper 36 from the state shown in FIG. 8, further movement of the coupler 61 to the inner peripheral side is restricted by side walls of the cover members 40*a* and 40*b*. Therefore, the non-contact state between the holder 62 and the welded portion 42 tends to be maintained.

The holder 62 is formed such that the distance D1 between the first contact portion 63 and the rim 41 and the distance D2 between the second contact portion 64 and the rim 41 gradually increase from the inner peripheral side toward the outer peripheral side of the rim 41. Therefore, contact portions between the holder 62 of the coupler 61 and the rim 41 of the diaphragm damper 36 are limited and, therefore, even if the damper device 35 vibrates, it is possible to prevent the occurrence of abnormal noise caused by a contact between the holder 62 and the rim 41 at portions other than such contact portions.

Since the plurality of couplers 61 are provided in the circumferential direction of the diaphragm dampers 36, the configuration as one unit of the diaphragm dampers 36 and the couplers 61 is stabilized. The rigidity of the cover members 40*a* and 40*b* is increased compared to the diaphragms 37*a* and 37*b* so that the cover members 40*a* and 40*b* are not easily deformed. Therefore, when the central portions 39 of the diaphragms 37*a* and 37*b* are bent away from each other, the central portions 39 are supported by the cover members 40*a* and 40*b* so that further deformation thereof is prevented. On the other hand, the support members 44 are disposed in the inner region 43 between the diaphragms 37*a* and 37*b* so that portions on the peripheral side of the central portions 39 are supported by the projections 44*b* of the support members 44. Accordingly, when the central portions 39 of the diaphragms 37*a* and 37*b* are bent toward each other, deformation of the portions on the peripheral side of the central portions 39 is prevented. Therefore, the occurrence of excessive stress due to deformation of the diaphragms 37*a* and 37*b* is prevented so that the durability of the diaphragms 37*a* and 37*b* is improved.

The embodiment described above can be carried out with the following changes. Further, the following modifications can also be carried out in combinations as appropriate. Each connecting portion 65 connecting between the holders 62 may be formed with a communication hole. In this case, the fuel can flow through the communication holes. It is to be noted that, in this case, the holder band 57 should be disposed such that the through-holes 60 correspond to the communication holes of the connecting portions 65.

The number of the couplers 61 is not particularly limited. Only one or a plurality of the couplers 61 may be provided in the circumferential direction of the diaphragm dampers 36. The distance D1 between the first contact portion 63 and the rim 41 and the distance D2 between the second contact portion 64 and the rim 41 do not necessarily increase from the inner peripheral side toward the outer peripheral side of the diaphragm damper 36. For example, the first contact portion 63 and the second contact portion 64 may extend parallel to the extending direction of the rim 41 and only their distal ends may be bent to the rim 41 side so as to be in contact with the rim 41. In this case, the distance D1 and the distance D2 are approximately constant from the inner peripheral side toward the outer peripheral side of the diaphragm damper 36. Alternatively, the distance D1 and the distance D2 may be set to decrease from the inner peripheral side toward the outer peripheral side of the diaphragm damper 36.

The length L1 of the holder 62 may be set to be equal to the length L2 of the rim 41 or may be set to be shorter than the length L2. In this case, it is desirable to prevent offset of contact positions between the first contact portion 63 and the rim 41 and between the second contact portion 64 and the rim 41 in the extending direction of the rim 41 by, for example, forming grooves on the rim 41 and locking distal ends of the first contact portion 63 and the second contact portion 64 with the grooves.

The connecting portion 66 of the holder 62 may be omitted. For example, the first contact portion 63 and the second contact portion 64 may each be formed into a semicircular shape in cross section so that the holder 62 on the whole may have a C-shape in cross section.

Three or more diaphragm dampers 36 may be provided. The holder band 57 may be omitted. The support members 44 may be omitted.

The configuration of the coiled wave spring 46 may be changed as appropriate. For example, a configuration in which the portion between the end turn portions 49 forms a flat coil, but not a corrugated coil, or a configuration in which the end turn portions 49 each form a corrugated coil may be employed.

The cover members 40*a* and 40*b* may be omitted. That is, a diaphragm damper may be formed by providing only the diaphragm 37*a* as a first flexible portion and only the diaphragm 37*b* as a second flexible portion and by overlapping the end portions 38 of the diaphragms 37*a* and 37*b* and then welding the peripheral edges of the end portions 38. In this configuration, the end portions 38 of the diaphragms 37*a* and 37*b* may be directly held by the holder 62 of the coupler 61.

The configuration of the welded portion 42 may be changed. For example, the length of the end portions 38 of the diaphragms 37*a* and 37*b* may be set to be shorter than the length of the rim 41 of the cover members 40*a* and 40*b* and welding thereof may be carried out separately. Alternatively, the length of the end portions 38 of the diaphragms 37*a* and 37*b* may be set to be greater than the length of the rim 41 of the cover members 40*a* and 40*b*, and welding of the cover member 40*a* and the diaphragm 37*a* and welding of the cover member 40*b* and the diaphragm 37*b* may be carried out separately.

The invention claimed is:

1. A damper device provided in a flow passage of a fluid, the damper device comprising:

a plurality of diaphragm dampers that are stacked together, each of the plurality of diaphragm dampers including a first flexible portion including a first diaphragm and a first cover member, a second flexible portion including a second diaphragm and a second cover member, and a rim including a welded portion, peripheral edges of the first diaphragm and the first cover member and peripheral edges of the second diaphragm and the second cover member being welded together in the welded portion, each of the plurality of diaphragm dampers being configured to seal a gas in an inner region between the first diaphragm of the first flexible portion and the second diaphragm of the second flexible portion, and a coupler that couples the plurality of diaphragm dampers together, the coupler including holders that hold the rims of the plurality of diaphragm dampers, a space being provided between the coupler and the welded portion of each of the plurality of diaphragm dampers such that the coupler does not contact the welded portion of each of the plurality of diaphragm dampers.

2. The damper device according to claim 1, wherein a length of the holder is greater than a length of the rim of each of the plurality of diaphragm dampers in a radial direction of the plurality of diaphragm dampers in a cross section including a central axis, where the central axis is a virtual straight line passing through respective centers of the plurality of diaphragm dampers in a stacked state.

3. The damper device according to claim 1, wherein the holder includes a first contact portion and a second contact portion, the first contact portion includes a distal end being in contact with the first flexible portion, the second contact portion includes a distal end being in contact with the second flexible portion, and a first distance between the first contact portion and the rim of each of the plurality of diaphragm dampers and a second distance between the second contact portion and the rim of each of the plurality of diaphragm dampers each increase from a radially inner side toward a radially outer side of the plurality of diaphragm dampers.

4. The damper device according to claim 1, wherein the coupler comprises a plurality of the couplers is-provided in a circumferential direction of the plurality of diaphragm dampers.

* * * * *